US006179897B1

(12) United States Patent
Kunnmann et al.

(10) Patent No.: US 6,179,897 B1
(45) Date of Patent: Jan. 30, 2001

(54) METHOD FOR THE GENERATION OF VARIABLE DENSITY METAL VAPORS WHICH BYPASSES THE LIQUIDUS PHASE

(75) Inventors: Walter Kunnmann, Stony Brook; John Z. Larese, Rocky Point, both of NY (US)

(73) Assignee: Brookhaven Science Associates, Upton, NY (US)

( * ) Notice: Under 35 U.S.C. 154(b), the term of this patent shall be extended for 0 days.

(21) Appl. No.: 09/271,890

(22) Filed: Mar. 18, 1999

(51) Int. Cl.[7] ..... C22B 26/00; C22B 26/22

(52) U.S. Cl. ..... 75/599; 75/594; 75/595; 75/596; 75/597; 75/598

(58) Field of Search ..... 423/439; 75/10.19, 75/10.25, 594, 595, 596, 597, 598, 599, 951; 34/329, 343, 345, 353, 416

(56) References Cited

U.S. PATENT DOCUMENTS

| | | | | |
|---|---|---|---|---|
| 4,190,434 | | 2/1980 | Bonfils et al. . | |
| 4,200,264 | * | 4/1980 | Hori | 266/149 |
| 4,226,739 | | 10/1980 | Cheng et al. . | |
| 4,437,886 | * | 3/1984 | Miura et al. | 75/67 |
| 4,543,122 | | 9/1985 | Bodenstein et al. . | |
| 4,545,975 | | 10/1985 | Kobayashi et al. . | |
| 4,572,736 | * | 2/1986 | Warren et al. | 75/10 |
| 4,604,118 | | 8/1986 | Bocko et al. . | |
| 4,699,653 | * | 10/1987 | Barcza et al. | 75/10.19 |
| 4,721,610 | | 1/1988 | Yoshida et al. . | |
| 4,786,490 | | 11/1988 | Yoshida et al. . | |
| 4,842,832 | | 6/1989 | Inoue et al. . | |
| 4,997,802 | | 3/1991 | Matsuura et al. . | |
| 5,039,509 | | 8/1991 | Miyata et al. . | |
| 5,106,608 | | 4/1992 | Retschnig et al. . | |
| 5,137,863 | | 8/1992 | Matsuura et al. . | |
| 5,383,953 | | 1/1995 | Christini . | |
| 5,658,367 | | 8/1997 | Jackman et al. . | |
| 5,782,952 | * | 7/1998 | Diaz et al. | 75/10.19 |

FOREIGN PATENT DOCUMENTS

| | | |
|---|---|---|
| 139208 | 5/1970 | (CS) . |
| 84/9885 | 12/1984 | (ZA) . |

* cited by examiner

*Primary Examiner*—Tom Dunn
*Assistant Examiner*—Cam N. Nguyen
(74) *Attorney, Agent, or Firm*—Margaret C. Bogosian

(57) ABSTRACT

The present invention provides a method for producing a metal vapor that includes the steps of combining a metal and graphite in a vessel to form a mixture; heating the mixture to a first temperature in an argon gas atmosphere to form a metal carbide; maintaining the first temperature for a period of time; heating the metal carbide to a second temperature to form a metal vapor; withdrawing the metal vapor and the argon gas from the vessel; and separating the metal vapor from the argon gas. Metal vapors made using this method can be used to produce uniform powders of the metal oxide that have narrow size distribution and high purity.

32 Claims, 1 Drawing Sheet

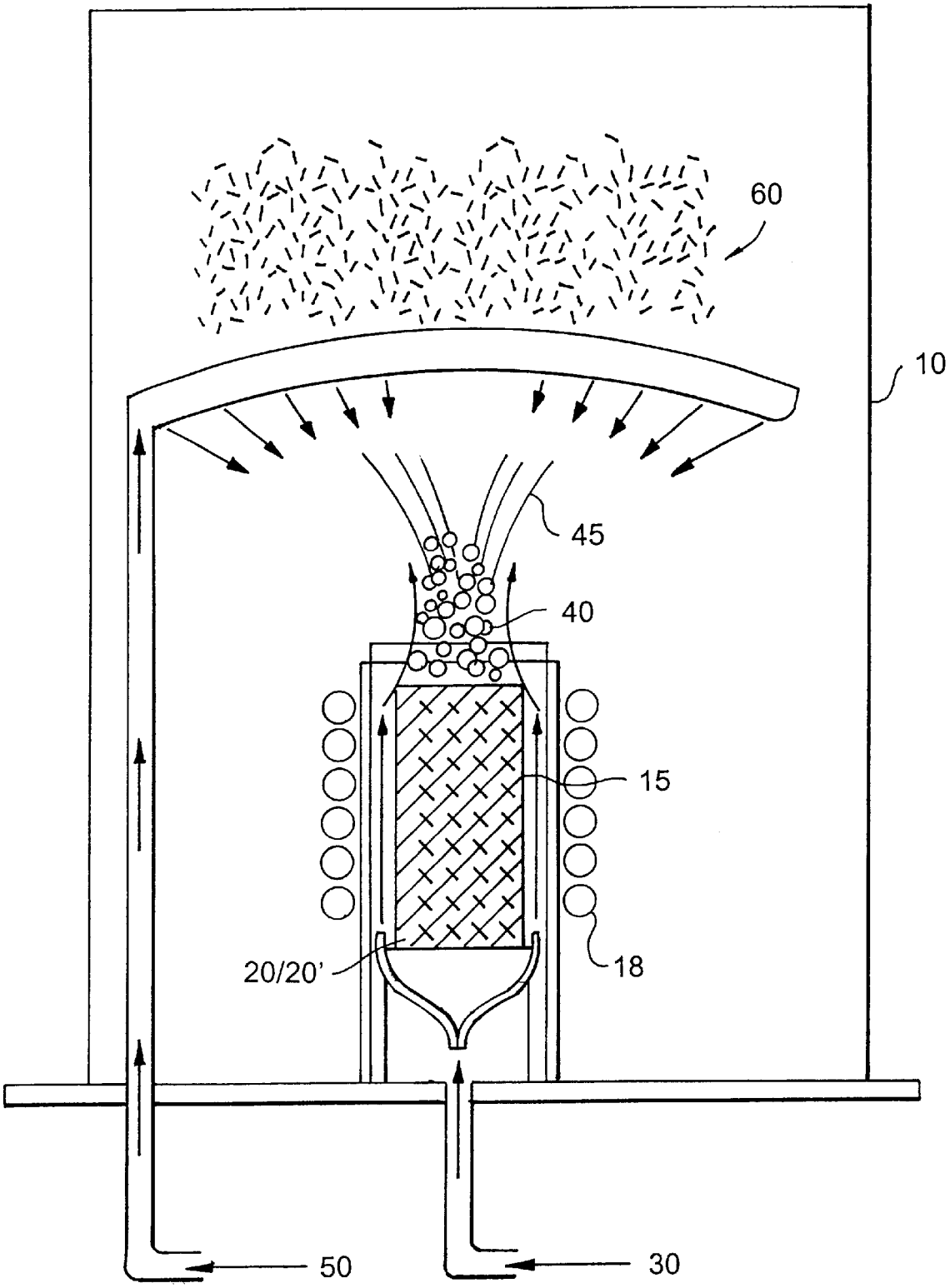
60
10
45
40
15
18
20/20'
50
30

METHOD FOR THE GENERATION OF VARIABLE DENSITY METAL VAPORS WHICH BYPASSES THE LIQUIDUS PHASE

This invention was made with Government support under contract number DEAC02-98CH10886, awarded by the U.S. Department of Energy. The Government has certain rights in the invention.

BACKGROUND OF THE INVENTION

The present invention relates to the production of variable density metal vapors, including magnesium vapor, that can be used to form uniform powders of metal oxides. More specifically, the invention relates to a method for the production of metal vapors formed from the decomposition of metal carbides which bypass the liquidus phase.

Powders formed from metal oxides are widely used in a variety of industries as ceramic materials, catalysts, pigments, coatings and fillers. Some metal oxides, such as magnesium oxide and calcium oxide, have excellent heat resistance and electrical insulating properties and are especially useful in the electronics industry.

There are several standard ways to produce metal oxide powders. The most obvious approach is direct elemental synthesis. For example, MgO can be formed either by burning metal Mg ribbon or entraining Mg vapor in a carrier gas stream. The formula for this reaction is:

$$2Mg(vapor)+O_2(vapor)\rightarrow 2MgO(solid) \quad (1)$$

While this method is simple in principle, it can be difficult in practice since it requires processing at high temperature which is not easily controlled. Also, this method can leave unreacted Mg in the final product and it is difficult to control the particle size of the metal oxide that is formed by such a method.

Another commonly used method for forming a metal oxide is the thermal decomposition of either the hydroxide or carbonate form of the metal. For example, MgO can be synthesized via the thermal decomposition of either magnesium hydroxide, magnesium carbonate or magnesium formate. For the hydroxide form, the formula for the reaction process is:

$$Mg(OH)2\rightarrow MgO+H_2O \quad (2)$$

This approach has the advantage of being simple, but irregular surface morphology, particle size distributions and surfaces terminated with hydroxyl groups are serious drawbacks.

It has been found that the particle size of metal oxide powders effects their characteristics and that very fine metal oxide powders exhibit unique properties that are not found in larger size particles. In particular, very fine metal oxide particles exhibit different magnetic and optical properties from those of larger metal oxide particles. This size dependant variation of physical properties is often desirable and so there is a need in the industry for a process that can produce small-size metal oxide particles.

It is known that fine metal oxide particles can be produced by various methods including liquid phase reaction methods and gas phase reaction methods. The gas phase reaction methods have been found to offer significant advantages because the oxidation of the metal vapors allows the particle size of the metal oxides to be controlled. The present invention provides a method for producing high purity metal vapors that are useful in forming metal oxide powders.

SUMMARY OF THE INVENTION

The present invention provides a method for producing a metal vapor that includes the steps of forming a metal carbide from a solid metal and a source of carbon in an oxygen-free and water-free atmosphere; and heating the metal carbide to form a vapor of the metal; wherein the solid metal is transformed to a vapor without transforming the metal to a liquid phase. Preferably, the source of carbon is graphite and the oxygen-free and water-free atmosphere is a dry, rare gas atmosphere, wherein the dry, rare gas is preferably argon gas.

The metal carbide is formed by heating the metal and the source of carbon to a first temperature which is preferably above the melting point of the metal. After, a period of time at the first temperature, the metal carbide is heated to a second temperature which is above the boiling point of the metal.

The molar ratio of the source of carbon to the metal is at least 2 to 1 and can vary depending on the metal that is being vaporized and the carbon source. The form and size of the metal and carbon materials that are used is also important. To provide rapid initial reaction time, the materials are preferably in the form of chips having a size of less than 5 cm.

In another embodiment, the present invention provides a method for producing a metal vapor that includes the steps of combining a metal and a carbon source, preferably graphite, in a vessel to form a mixture; heating the mixture to a first temperature in a dry, rare gas atmosphere to form a compound of the metal and carbon; maintaining the first temperature for a period of time; heating, the compound to a second temperature to form a metal vapor; and withdrawing the metal vapor from the vessel.

The pieces of metal and graphite are small in size so that they can be intimately mixed tog,ether into a uniform mixture, preferably the metal and graphite are in tile form of chips having a size of less than 5 cm. Graniular particles of metals and graphite are particularly well suited for the process. The molar ratio of the graphite to the metal is at least 2 to 1 and may be as high is 10 to 1 for some metals. The metal and graphite mixture is placed in a vessel, preferably a graphite crucible, and slowly heated to a first temperature which is greater than the melting point of the metal. As the metal begins to melt, a metal carbide compound is formed from the metal and the carbon in the graphite. The vessel has a dry, rare gas atmosphere preferably argon gas, which is substantially inert and does not react with the metal.

When the temperature of the mixture of metal and graphite reaches the melting point of the metal, the heat is maintained constant so that the temperature remains at approximately the melting point for a short period of time. Approximately 2 to 3 minutes is sufficient for most metals but additional heating, does not adversely effect the process. At the end of this short period of time, the metal carbide compound is heated to a second temperature which is greater than the boiling point of the metal to vaporize the metal portion of the metal carbide compound.

The metal vapors formed by the method of the present invention can be oxidized to produce metal oxide powders. A dopant can be combined with the metal vapors, during or just prior to oxidation, to produce modified metal oxides. In a preferred embodiment, the metal carbide is contacted with a dopant either before the metal carbide is formed or prior to heating the metal carbide to form the metal vapor. The dopant can be any metal powder, with iron, copper, nickel and zinc being the preferred metal powders.

A preferred embodiment of the present invention is a method for the production of magnesium vapor comprising: combining magnnesium and graphite in a vessel to form a mixture; heating the mixture at a first temperature in a dry, rare gas atmosphere, preferably argon gas, to form a compound of magnesium and carbon; maintaining the first temperature for a period of time; heating the compound to a second temperature to form a magnesium vapor; withdrawing the magnesium vapor and rare gas from the vessel; and optionally separating the magnesium vapor from the rare gas.

The molar ratio of graphite to magnesium is at least 2 to 1 and preferably at least 3 to 1. The magnesium and graphite are small in size so that they can be easily mixed together and provide the maximum surface contact between the two materials. Preferably, the magnesium and graphite are in the form of chips having a size of less than 5 cm. The mixture of magnesium and graphite is heated to a first temperature of between 600 C and 750 C, preferably between 650 C and 700 C, and is kept at this temperature for several minutes, preferably 2 to 3 minutes, before being heated to a second temperature of between 1050 C and 1150 C, preferably about 1100 C.

The magnesium vapors formed by the method of the present invention can be oxidized to produce magnesium oxide powders. A dopant can be combined with the magnesium vapors, during or just prior to oxidation, to produce modified magnesium oxides. In a preferred embodiment, the magnesium carbide is contacted with a dopant either before the magnesium carbide is formed or prior to heating the magnesium carbide to form the magnesium vapor. The dopant can be any metal powder, with iron, copper, nickel and zinc being the preferred metal powders.

The method of the present invention provides better control over the reaction rates and particle size distributions than prior art methods to produce uniform powders of metal oxides characterized by narrow size distributions. It has been found that the greatest particle size distribution occurs when low density metal vapors are formed in controlled inert gas streams. In contrast, the present invention forms significantly higher density metal vapors in a rapid, chaotic oxidizing environment which results in metal oxide powders having, narrow size distributions. The temperature of the metal carbide compound can be adjusted to control the production rate and density of the metal vapor. A significant advantage of the present invention is that the metal is not directly transformed from its solid to liquid state. Instead, the metal first forms a metal carbide compound. Thereafter, a metal vapor is formed when the metal carbide compound is heated above the boiling point of the metal. This allows the present method to bypass the dangers and difficulties associated with prior art methods of metal synthesis which require the formation of a molten metal at high temperatures.

BRIEF DESCRIPTION OF THE DRAWINGS

Other objects and many attendant features of this invention will be readily appreciated as the invention becomes better understood by reference to the following detailed description when considered in connection with the accompanying drawing wherein:

FIG. 1 shows a graphite crucible that can be used for carrying out the present invention.

DETAILED DESCRIPTION OF THE PREFERRED EMBODIMENTS

The present invention provides a method for producing a metal vapor which includes heating a mixture of a metal and graphite in a dry, rare gas atmosphere in a controlled manner to form either thermally unstable carbides or to absorb the metal within the porous graphite structure. The preferred metals that are used in this process are magnesium, zinc, copper, silver, calcium and aluminum, with magnesium and zinc being the most preferred. The metal vapors produced by the method of the present invention can be combined with oxygen using methods well known in the art to produce uniform powders of metal oxides having narrow size distribution and uniform crystallographic face exposure.

Metal vapors are produced in accordance with the present invention by combining a metal and graphite in a vessel, preferably a graphite crucible, to form a mixture. The molar ratio of the graphite to the metal is at least 1 to 1 and may be as high as 10 to 1 for some metals. A molar ratio of about 3 to 1 is preferred. The metal and graphite are in the form of chips having, a size of less than 5 cm. Larger pieces of metal and graphite can be used but the smaller pieces make it easier to mix the metal and graphite together and provide a more uniform mixture. Preferably, the metal and graphite are in granular form. The smaller pieces also provide for more intimate contact between the metal and graphite which facilitates the formation of the metal carbide compound. The metal is preferably provided in a pure form but the method can also be used when the metal contains impurities or other metals and compounds. The graphite can be in the form of a powder, rods, plates or fibers, with thin plates being preferred. Both naturally occurring graphite and synthetically produced graphite can be used.

The vessel that is used for the method of the present invention must be capable of operating at temperatures above the boiling point of the metals that are being vaporized and the vessels must provide an environment that maintains a rare gas atmosphere while the vessel is in operation. A graphite crucible is preferred, however, various metal furnaces that can be arranged in a columnar form, such as induction type can be used.

FIG. 1 shows a graphite crucible 10 in which the metal and graphite mixture 20 are contained in a vessel 15 and a dry, rare gas 30 is used to purge the vessel 15 of all oxygen and moisture and to create a rare gas atmosphere in the vessel 15. The rare gas 30, which is sometimes referred to as a "noble gas" or, less accurately, as an "inert gas," is selected from the group consisting of argon, helium, neon, and krypton, with argon gas being the preferred rare gas. The metal and graphite mixture 20 is gradually heated by a plurality of heating coils 18 on the outside of the vessel 15 to a first temperature (approximately the temperature of the melting point of the metal) in the dry, rare gas atmosphere to form a compound 20 of the metal and carbon. The rare gas 30 does not react with the metal and, therefore, does not interfere with the reaction between the metal and the graphite.

It is believed that, as the temperature increases, the metal and the graphite combine to form metal carbide compounds 20 at the first temperature as follows:

$$\text{Metal}+\text{Carbon}\rightarrow\text{Metal Carbide} \quad (3)$$

The first temperature that the metal and graphite mixture 20 is heated to is approximately the melting point of the metal. However, this temperature may vary by as much as ±50 C based on a number of factors, including the amount and type of any impurities in the metal carbide compound 20, the type of graphite, the gas pressure within the vessel 15 and the molar ratio of metal to graphite. When the metal carbide mixture 20 reaches the first temperature, the temperature is maintained at this point for a short period of time to allow for all of the metal in the bath to achieve a molten state and to form a metal carbide compound 20. Typically, the temperature is maintained for a few minutes. Magnesium, for example, is held at a temperature of approximately 700 C for from 2 to 3 minutes.

After the metal carbide mixture 20 has achieved a molten state wherein a solid metal carbide compound 20 is formed, the heat is increased and the temperature of the compound 20 is raised to a second temperature. The second temperature is at or above the decomposition point of the metal carbide 20, typically at or above the boiling point of the metal, and at this temperature metal vapors 40 begin to rise from the metal carbide compound 20. The reaction for the formation of the metal vapor 40 from the metal carbide compound 20 is believed to be as follows:

$$\text{Metal Carbide} \rightarrow \text{Metal Vapor} + \text{Carbon (solid)} \quad (4)$$

and $$\text{Absorbed Metal in Graphite Pores} \rightarrow \text{Metal Vapor} + \text{Graphite (solid)} \quad (5)$$

The method of the present invention bypasses the liquid metal state by forming the metal vapors 40 from the solid metal carbide compound 20 instead of from a pure molten metal. Those skilled in the art will appreciate the significance of this difference because the present method avoids the difficulties and dangers of processing and handling a pure liquid metal such as magnesium.

Graphite sublimes at approximately 3650 C and, therefore, will remain substantially in a solid state at the processing temperatures of the present invention. However, at the lower operating temperatures of the present invention, it has been found that metals react with some of the carbon in the graphite to form metal carbide compounds 20. At temperatures above the melting point of the metals, the metal carbide compounds 20 are in a solid state. When the temperature approaches the boiling point of the metal, the metal portion of the metal carbide compound 20 vaporizes and the graphite remains. The metals will only continue to vaporize as long as the temperature of the metal carbide compound 20 is above the boiling point of the metal. The density of the metal vapor 40 that is produced by the reaction can be adjusted by varying the temperature of the metal carbide compound 20. When the temperature is reduced, the process instantly stops. This is a distinct advantage over prior art processes since it provides a safe method of producing metal oxides.

As the metal vaporizes, the metal vapor 40 formed is withdrawn from the vessel 15 in a stream 45 of rare (,as, sometimes referred to as a "sweeping gas" because it sweeps the product gas out of the vessel. The metal vapors 40 formed by the method of the present invention are high in quality because the metal carbide 20 can be controlled within a narrow temperature range to yield a homogeneous vapor 40 with a minimal amount of impurities. This is attributed to the gettering (i.e., scavenging) properties of the carbon material towards those elements which form stable carbides at the temperature of interest.

The metal vapor 40 produced by the process of the present invention can be used to form metal oxide powders 60 by combining the metal vapors 40 with oxygen 50. The high purity of the metal vapors 40 together with the controlled oxidation produce uniform powders 60 of metal oxides which are characterized by narrow size distributions.

EXAMPLE 1

The Mg vapor used for producing MgO was prepared by loading magnesium chips into the bottom of a graphite crucible and filling the crucible with a large amount (molar ratio of carbon (i.e., graphite) to magnesium is greater than 3 to 1) of crushed, coarse-grained granules of graphite. The graphite was loaded in the crucible so that the magnesium metal was completely surrounded by the graphite. The graphite crucible was heated slowly to approximately 700° C. (red heat) using inductive heating (Lepal RF (generator) so that the reaction of the Mg with the carbon was carried out in-situ in a flowing, dry, rare gas atmosphere (dry argon gas was used). Under these thermodynamic conditions, the Mg metal was just above its melting point (magnesium has a melting point of 650 C) where it was rapidly absorbed by, and subsequently reacted with, the carbon granules to form a non-stoichiometric Mg-carbon compound. At this point (~700° C.), a noticeable increase in the crucible temperature and a drop in the height of the mass within the crucible takes place without an increase in the heater power. After a short (2–3 minute) induction period at 700° C.–800° C., the exterior crucible temperature was increased slowly to approximately 1100° C. The internal temperature of the crucible was not measured but was estimated to be lower than 1100° C., because the decomposition of the Mg-carbon compound is endothermic. Since the reaction is endothermic, it is inherently safer and easier to control than exothermic processes. At 1100° C., Mg vapor (magnesium has a boiling point of 1107 C) was observed above the crucible and was subsequently entrained by the flowing inert argon gas stream.

MgO powder was then formed by adding oxygen to the Mg vapor containing argon gas stream using a known method.

It is believed that, as the temperature increases, the magnesium and the graphite combine to form magnesium carbide compounds as follows:

$$2Mg + 3C \rightarrow Mg_2C_3 \quad (6)$$

and $$Mg + 2C \rightarrow Mg_2C_3 \quad (7)$$

In equation (5), the $Mg_2C_3$ formed has a carbon content of about 42 wt. % and in equation (6), the $MgC_2$ formed has a carbon content of about 50 wt. %. $MgC_2$ is stable up to approximately 600° C. at which temperature it decomposes as follows:

$$2MgC_2 \rightarrow Mg_2C_3 + C \quad (8)$$

At about 1050° C., $Mg_2C_3$ decomposes into Mg vapor and C.

The density of the Mg vapor within the gas stream can be adjusted by varying the temperature of the vessel. It is important to note that this is not what happens in a boiling vat of Mg in an open, non-reacting, vessel. If the temperature of the carbon crucible is reduced (even slightly) from the decomposition point, the generation of Mg vapor is virtually eliminated. This observation clearly establishes that there is the formation of a Mg-carbon compound. Furthermore, this feature offers a built-in safety mechanism for the production of Mg vapors, since it eliminates the presence of a liquid Mg phase normally present at these elevated temperatures. Magnesium oxide powder can be formed by adding oxygen to the magnesium vapor/argon gas flow stream using known methods.

The graphite material used in the process can be reused in subsequent processing. Any elemental impurities, which may be present in the starting material (e.g. transition metals) and which form stable solid carbides, remain trapped within the graphite granules and remain in the vessel. This chemical purification feature of graphite for generating metal vapors, such as magnesium vapor, ultimately makes the starting graphite granules unsuitable for reuse and will effect the purity of the metal oxide that is formed, as it begins to "age." Therefore, the graphite should be replaced frequently to maintain the efficiency of the process.

This same phenomenon (i.e., the breakdown of metal carbon compounds) can also be exploited to produce precise, ultra-low doping levels of other elements into the metal oxide materials. This is true for all elements which form solid carbides because it allows for exact control over the ratio of the dopant vapor to metal vapor. At constant temperature, chemical equilibrium conditions dictate a precise elemental composition for the vapor (assuming that the total pressure sum remains constant). Example 2 demonstrates how ultra-low doping levels of other elements into the metal oxide materials is achieved.

EXAMPLE 2

Mg vapors were doped with iron (Fe) by loading a graphite crucible with graphite and magnesium chips. A layer of cementite ($Fe_3C$) in powdered form was then placed on top of the Mg-carbon mixture. The contents of the crucible were then heated following a procedure similar to the procedure used in Example I so that the Mg vapor released by the $Mg_2C_3$ came in intimate contact with the $Fe_3C$ as the vapor passed through the powder. Since the Mg vapor is produced by a reversible decomposition of $Mg_2C_3$, it is believed that the Mg vapor undergoes phase changes as it passes through the $Fe_3C$ powder and a thermodynamic equilibrium is established between the Mg vapor and the $Fe_3C$ particles. This thermodynamic equilibrium involve only solid and vapor phases and results in the addition (i.e., doping) of iron atoms into the Mg vapor in a well-defined and non-varying ratio. The doping of the Mg vapor with Fe continues as long as the temperature and total pressure in the crucible remain fixed (i.e., the thermodynamic system has zero degrees of freedom).

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

What is claimed is:

1. A method for producing a metal vapor comprising:

forming a metal carbide from a solid metal and a source of carbon in an oxygen-free and water-free atmosphere; and heating said metal carbide to form a vapor of said metal in said atmosphere; wherein said solid metal is transformed to said vapor without reducing said metal to a liquid phase.

2. The method for producing a metal vapor according to claim 1, wherein said source of carbon is graphite.

3. The method for producing a metal vapor according to claim 2, wherein said metal and graphite have a particle size of less than 5 cm.

4. The method for producing a metal vapor according to claim 1, wherein said oxygen-free and water-free atmosphere is a dry, rare gas atmosphere.

5. The method for producing a metal vapor according to claim 3, wherein said dry, rare gas is argon gas.

6. The method for producing a metal vapor according to claim 5, wherein the molar ratio of said source of carbon to said metal is at least 2 to 1.

7. The method for producing a metal vapor according to claim 6, wherein said metal carbide is formed by heating said metal and said source of carbon to a first temperature, and wherein said first temperature is above the melting point of said metal.

8. The method for producing a metal vapor according to claim 1, wherein said metal carbide is heated to a second temperature which is above the boiling point of said metal.

9. The method for producing a metal vapor according to claim 1, wherein said source of carbon is graphite, the molar ratio of said graphite to said metal is at least 2 to 1, said metal and graphite have a particle size of less than 5 cm, and said oxygen-free and water-free atmosphere is argon gas.

10. The method for producing a metal vapor according to claim 1, further comprising contacting said metal carbide with a dopant prior to heating said metal carbide.

11. The method for producing a metal vapor according to claim 10, wherein said dopant is a metal powder selected from the group consisting of iron, copper, nickel and zinc.

12. A method for producing magnesium vapor comprising:

forming a magnesium carbide from a solid magnesium and a source of carbon in an oxygen-free and water-free atmosphere; and heating said magnesium carbide to form a magnesium vapor in said atmosphere; wherein said solid magnesiunm is transformed to said magnesium vapor without reducing said magnesium to a liquid phase.

13. The method for producing magnesium vapor according to claim 12, wherein said source of carbon is graphite.

14. The method for producing magnesium vapor according to claim 13, wherein said magnesium and graphite are in the form of chips having a particle size of less than 5 cm.

15. The method for producing magnesium vapor according to claim 12, wherein said oxygen-free and water-free atmosphere is a dry, rare gas atmosphere.

16. The method for producing magnesium vapor according to claim 15, wherein said dry, rare gas is argon gas.

17. The method for producing magnesium vapor according to claim 12, wherein said magnesium carbide is formed by heating said magnesium and said source of carbon to a first temperature.

18. The method for producing magnesium vapor according to claim 17, wherein the molar ratio of said source of carbon to said magnesium is at least 2 to 1.

19. The method for producing magnesium vapor according to claim 17, wherein said first temperature is above the melting point of said magnesium.

20. The method for producing magnesium vapor according to claim 12, wherein said magnesium carbide is heated to a second temperature which is above the boiling point of said magnesium.

21. The method for producing magnesium vapor according to claim 12, further comprising contacting said magnesium carbide with a dopant prior to heating said magnesium carbide.

22. The method for producing magnesium vapor according to claim 21, wherein said dopant is a metal powder selected from the group consisting of iron, copper, nickel and zinc.

23. A method for producing magnesium vapor comprising:

combining magnesium and graphite in a vessel to form a mixture;

heating said mixture at a first temperature in a dry, rare gas atmosphere to form a magnesium carbide;

maintaining said first temperature for a period of time;

heating said magnesium carbide to a second temperature to form a magnesium vapor and a dry, rare gas;

withdrawing said magnesium vapor and said dry, rare gas from said vessel; and separating said magnesium vapor from said dry rare gas.

24. The method for producing magnesium vapor according to claim 23, wherein the molar ratio of graphite to magnesium is at least 2 to 1.

25. The method for producing magnesium vapor according to claim 23, wherein said magnesium and graphite have a particle size of less than 5 cm.

26. The method for producing magnesium vapor according to claim 23, wherein said first temperature is above 650° C.

27. The method for producing magnesium vapor according to claim 23, wherein said rare gas is argon gas.

28. The method for producing magnesium vapor according to claim 23, wherein said second temperature is above 1100° C.

29. The method for producing magnesium vapor according to claim 23, wherein said period of time is between 2 and 3 minutes.

30. The method for producing magnesium vapor according to claim 23, further comprising contacting a metal carbide with a dopant prior to heating said metal carbide.

31. The method for producing magnesium vapor according to claim 30, wherein said dopant is a metal powder selected from the group consisting of iron, copper, nickel and zinc.

32. The method for producing magnesium vapor according to claim 23, wherein said dry, rare gas is argon gas.

* * * * *